United States Patent [19]

Kimmich

[11] 4,050,411

[45] Sept. 27, 1977

[54] APPARATUS FOR MARKING INSULATED ELECTRICAL CONDUCTORS

[75] Inventor: Klaus Kimmich, Stuttgart, Germany

[73] Assignee: International Standard Electric Corporation, New York, N.Y.

[21] Appl. No.: 682,301

[22] Filed: Apr. 30, 1976

[30] Foreign Application Priority Data

May 14, 1976 Germany ..... 2521529

[51] Int. Cl.[2] ..... B05B 5/00

[52] U.S. Cl. ..... 118/625; 118/629; 118/630

[58] Field of Search ..... 118/625, 629, 630, 621; 210/188, 323 T, 436, 472

[56] References Cited

U.S. PATENT DOCUMENTS

| | | | |
|---|---|---|---|
| 2,018,901 | 10/1935 | Rush | 210/436 X |
| 3,000,467 | 9/1961 | Bowers | 210/436 X |
| 3,061,102 | 10/1962 | Mayer | 210/436 |
| 3,638,612 | 2/1972 | Haise et al. | 118/625 |

*Primary Examiner*—Louis K. Rimrodt

*Attorney, Agent, or Firm*—John T. O'Halloran; Thomas M. Marshall

[57] ABSTRACT

A straining filter which has an opening at the highest point of the filter dome is inserted in the pipe which supplies the spray nozzles and is further connected to the opening of an additional pipe. Spray nozzles acted on by an electrical field supply colored marking rings to a cable or wire. The material to be sprayed is held in the storage tank and is transferred by a gear pump through a buffer vessel and into a pipe. Inserted in the pipe is a double walled straining filter whose outlet is connected to a pipe running to the spray nozzles, with a valve and a pressure gauge inserted between the straining filter and each spray nozzle. Any gas bubbles introduced into the straining filter with the color material gather at the highest point of the filter dome and are carried away therefrom.

4 Claims, 2 Drawing Figures

APPARATUS FOR MARKING INSULATED ELECTRICAL CONDUCTORS

BACKGROUND OF THE INVENTION

1. Field of the Invention

Devices for applying colored markings to cables.

2. Prior Art

The subject of this invention is useful in a system disclosed in U.S. Pat. No. 3,638,612 assigned to the assignee of this invention. That invention discloses a device for marking a longitudinally advancing conductor or cable, which has been freshly extruded with plastic insulation, by a stream of fluid material of a predetermined color. The stream is first ejected from a high pressure nozzle and is sinusoidally deflected by an electrical deflection means. Then the deflection is amplified to be substantially larger than the cross sectional dimension of the cable by an electrical amplifying means before the stream is applied transversely to the cable. Where a complete band mark needs to be made around the cable a second stream may be applied to the cable opposite to the side being marked by the first stream by deflecting amd amplifying the second stream in the same manner as the first stream.

The device described in U.S. Pat. No. 3,638,612 has proved very effective in practice. A stream of color material being ejected from the spray nozzle and deflected by the electric alternating field applied to the electrodes through which the stream passes exerts a force on the more or less chargeable particles distributed in the color material. To achieve an as homogeneous distribution as possible of the more or less electrically charged particles of the color-material/solvent mixture, it is proved to be an advantage to pass the mixture through a large double straining filter before feeding it to the spray nozzles. Because of the presence of very low boiling components of the color-material/-solvent mixture there is a distinct possibility that ambient air will be sucked in and there is a risk that the solvent vapors, separating from the mixture on the intake side of the pump, will move as gas bubbles into the spray nozzles. In the spray nozzles this results in a short time interruption of the stream of color material and simultaneously in the particles of the color-material being atomized. Under the influence of the high voltage alternating field these particles reach the deflecting electrodes which produces field distortions. The result is that the distortion of the amplitude of the stream of color material and in the extreme case even an interruption of the same.

Other prior art devices as represented by U.S. Pat. Nos. 3,631,654; 3,650,862; 3,668,822; 3,786,618 and 3,912,468 have been disclosed but do not provide the structure and advantages of the device of this invention.

SUMMARY OF THE INVENTION

It is therefore the object of this invention to provide means which prevent any gas bubbles from reaching the spray nozzles and producing the above described disadvantages.

The invention is characterized by providing a straining filter having an opening at the highest point of the filter dome which is inserted in the pipe running or leading to the spray nozzle and which is connected to the opening of an additional pipe. Advantageously a continuously adjustable valve, which may be a hose clamp, is provided in the additional pipe and also it is of an advantage if the additional pipe is made from a transparent material.

BRIEF DESCRIPTION OF THE DRAWINGS

This invention will be more readily understood in its details by reference to the accompanying drawings, in which.

DESCRIPTION OF THE PREFERRED EMBODIMENT

Figure 1:
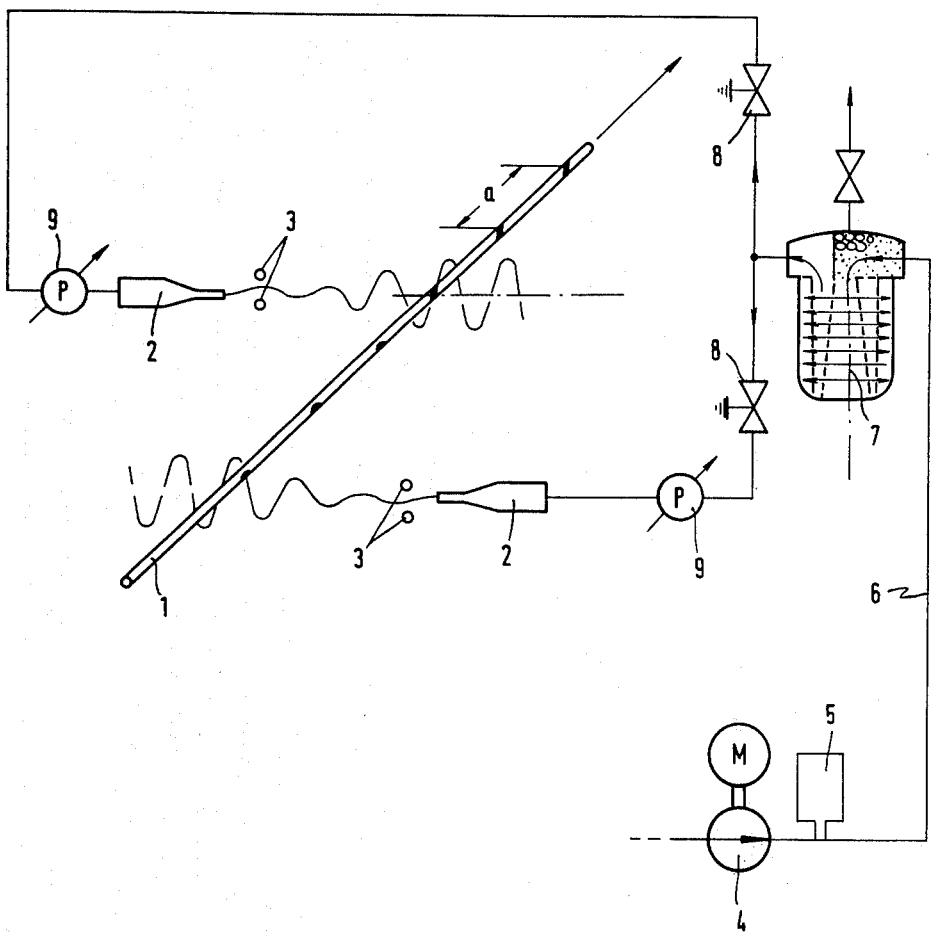
FIG. 1 shows schematically the circuit for the color material in the apparatus for marking insulated electrical conductors.

Referring to FIG. 1, the insulated electrical conductor 1 can be seen which it to be provided with color marking rings at intervals *a* which advances in the direction of the arrow. The marking ring is formed successively from two half rings each which is produced by a spray nozzle 2. These spray nnozzles are disposed on opposite sides of the conductor 1 at such an axial distance from each other that the amplitude of the second stream of color-material is 0 when the first half ring passes by the second spray nozzle. The deflection of the stream of color-material is effected by the deflecting-electrodes system 3 which are subjected to a high sinusoidal alternating voltage.

The circuit for the color-material consists of a storage tank for the color material (not shown) from which the color material is transferred, by gear pump 4 driven by motor M through a buffer vessel 5 (dashpot) into the pipe 6. Inserted in the pipe 6 is a double wall straining filter 7 whose outlet is connected to the pipe leading to the spray nozzles, with a valve 8 and a pressure gauge 9 inserted between the straining filter 7 and each spray nozzle. The color material which does not deposit on the conductor 1 is collected in well-known catch devices (not shown) and returned to the storage tank.

Figure 2:
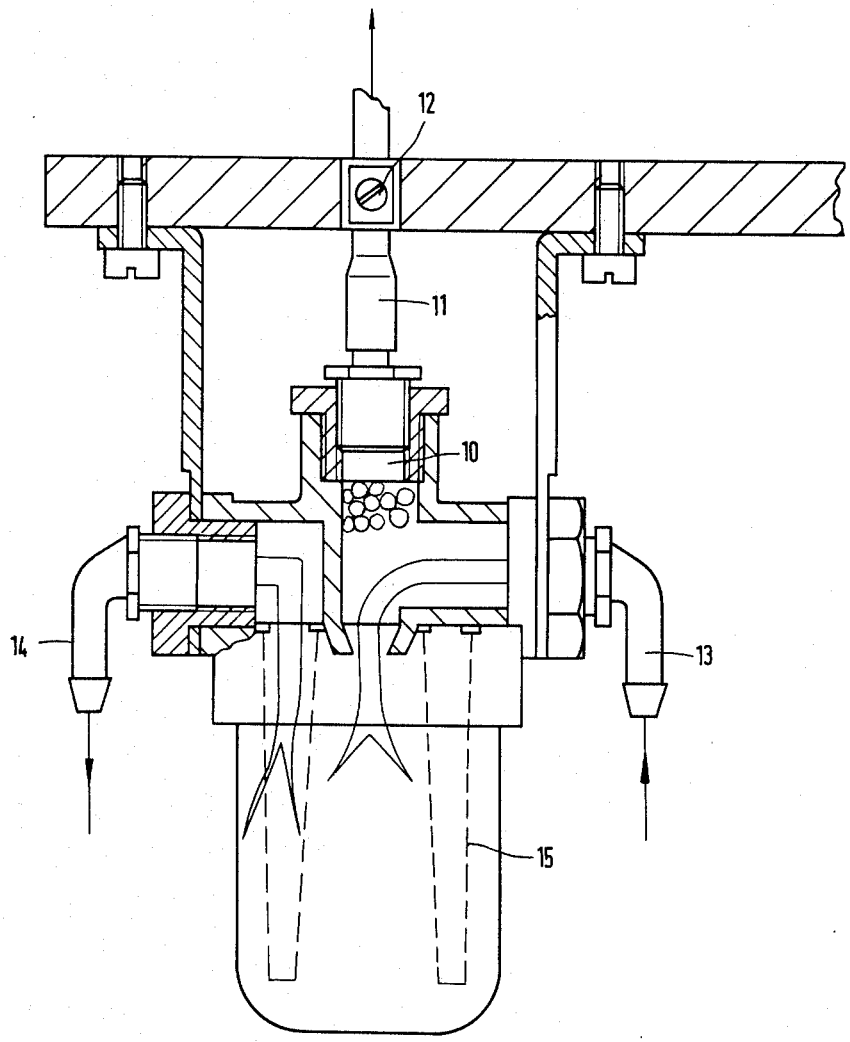
FIG. 2 is a partly cross sectional view of the straining filter in accordance with this invention.

The details of the design of straining filter 7 is shown in FIG. 2. At the highest point of the filter dome, there is an opening 10 to which the pipe 1 running back to the storage tank is connected. Above the opening 10, a valve 12, for example a hose clamp, is inserted into the pipe 11.

The color-material moves through the inlet connection 13 into the straining filter 7, passes through this filter on the path indicated by the arrows and leaves it again through the outlet connection 14. The double wall filter 15 to which the color-material is passed, has a mesh size of, for example 5% of the nozzle diameter.

Any gas bubbles introduced into the straining filter 7 with the color material will gather at the highest point of the filter dome as can be seen in FIG. 2 and will be carried away with a small stream of color material adjustable by means of valve 12. Since a quasi-stationary flow condition exists in the straining filter because of the relatively small throughput of color material, the gas bubbles are safely prevented from being swept along into the pipe leading to the spray nozzles.

If the pipe 11 connected to the opening 10 is transparent it may simultaneously serve as a visual indication of the state of the color material circuit. If major quantities of gas bubbles are visible in this pipe, this will indicate to the operator of the marking apparatus that an unduly large quantity of foreign air is being sucked in due to a defect, for example, because the stuffing box for sealing the axle of the gear pump is leaking and has to be retightened or replaced.

While the device of this invention has been described in relation to a specific embodiment, it wil be appreciated by those skilled in the art that modifications may be made which do not depart from the spirit and scope of the appended claims.

What is claimed is:

1. Improvements in apparatus for marking insulated electrical conductors with a stream of color material continuously emerging under pressure from a spray nozzle disposed with respect to an electrical conductor, which stream is deflected under the action of an electrical alternating field, said stream of color material being supplied by supply means for said color material including a supply pipe leading from said supply of color material to said nozzles, said improvement comprising:

insertion of a straining filter having an opening at its highest point positioned in said pipe leading from said supply of color material to said spray nozzles; and said straining filter having a connection at said highest point to a return supply pipe for returning a small portion of said color material to said supply color material along with any gas bubbles which form during the course of said supply to said spray nozzles.

2. The device according to claim 1 further including a continuously adjustable valve inserted into said return pipe above said highest point.

3. The device according to claim 2 wherein said valve is a hose clamp.

4. The device according to claim 1 wherein said return pipe is made of a transparent material.

* * * * *